US005267508A

United States Patent [19]

Yoshino

[11] Patent Number: 5,267,508

[45] Date of Patent: Dec. 7, 1993

[54] AUTOMATIC PACKAGE STRAPPING MACHINE

[75] Inventor: Suefumi Yoshino, Shijonawate, Japan

[73] Assignee: Shoko Kiko Co., Ltd., Osaka, Japan

[21] Appl. No.: 952,995

[22] Filed: Sep. 29, 1992

[30] Foreign Application Priority Data

Oct. 1, 1991 [JP] Japan ..... 3-079696[U]

[51] Int. Cl.[5] ..... B65B 13/32

[52] U.S. Cl. ..... 100/26; 53/589; 100/33 PB; 156/499; 156/502

[58] Field of Search ..... 100/4, 26, 29, 32, 33 PB; 53/589; 156/73.5, 494, 499, 502

[56] References Cited

U.S. PATENT DOCUMENTS

| | | | |
|---|---|---|---|
| 3,771,436 | 11/1973 | Sato | 100/33 PB |
| 4,020,756 | 5/1977 | Weiss | 100/33 PBX |
| 4,527,379 | 7/1985 | Bartzick et al. | 100/33 PBX |
| 4,850,179 | 7/1989 | Takami | 100/33 PBX |
| 4,850,180 | 7/1989 | Takami | 100/33 PBX |

FOREIGN PATENT DOCUMENTS

| | | | |
|---|---|---|---|
| 2363275 | 6/1974 | Fed. Rep. of Germany | 100/33 PB |

*Primary Examiner*—Stephen F. Gerrity
*Attorney, Agent, or Firm*—Wenderoth Lind & Ponack

[57] ABSTRACT

An automatic package strapping machine having a sliding plate movable in a table between a forward position and a rearward position, a first clamp under the forward position of the sliding plate and movable up and down to press a leading end of a strap inserted under the sliding plate from one side of the sliding plate against the under side thereof, a second clamp under the forward position of the sliding plate and movable up and down to fix a part of the strap extending thereover and the leading end of the strap against the under side of the sliding plate, a pressing device under the forward position of the sliding plate and movable up and down for cutting the strap as the pressing device is moving up relative to the first clamp and for pressing the part of the strap and the leading end thereof against the under side of the sliding plate, a heater for, in a forward position, being held between the part of the strap and the leading end thereof and fusing surfaces of the part of the strap and the leading end thereof, a strap feeding means for feeding a strap through a passage in the first clamp, over the pressing device and the second clamp and in an arch over the table, a strap guide adjacent the second clamp and movable back and forth between a position over the second clamp and the pressing device and is spaced therefrom to form a strap path over the second clamp and the pressing device and leading to the arch, and a retracted position, and a device for moving the strap guide to the projected position when the second clamp moves upwardly.

3 Claims, 4 Drawing Sheets

AUTOMATIC PACKAGE STRAPPING MACHINE

FIELD OF THE INVENTION

This invention relates to an automatic package strapping machine for tightening a thermoplastic strap looped around a package and welding both ends of the strap, and more particularly, to an automatic package strapping machine capable of speeding up the process of packaging.

PRIOR ART

Automatic package strapping machines adapted to strap a package with a thermoplastic strap and weld both ends of the strap by heat and pressure are in wide use.

The basic structure of such an automatic package strapping machine will now be described with reference to FIGS. 1 and 2. A sliding plate 2 is disposed at the upper side of a table 1 so as to move back and forth freely. A first clamp 3, a second clamp 4 and a pressing device 5 located between the clamp 3 and 4 are disposed just under the sliding plate 2 so that they can move up and down freely. A strap feeding device 6 and a strap-tightening device 7 are disposed on the right side of the first clamp 3 in FIG. 1. A heater (not shown here) is provided between the sliding plate 2 and the pressing device 5 so as to be movable back and forth therebetween. Further, an arch-shaped frame 8 is provided on the table 1 so that the strap 51 can be looped around a package 52 to be strapped.

A leading end of the strap 51 is inserted under the sliding plate 2 after being passed through a strap passage 9 from the arch 8 and is pressed and fixed to the sliding plate 2 by the first clamp 3 which moves up against plate 2. A passage 10 for the strap 51 is provided at the vicinity of the upper end of the first clamp 3. The strap 51 fed by the device 6 passes through the passage 10 and is guided by the under surface of the sliding plate 2 and goes into a strap passage 11 on the left side in FIG. 1 and passes throughout the arch 8 and goes into the strap passage 9 on the right side in FIG. 1. The leading end of the strap 51 goes along the under surface of the sliding plate 2, and the device 6 which feeds the strap stops when the leading end of the strap 51 presses a limit switch which also acts as a stopper (not shown here).

The strap 51 and the trailing end thereof which extends to the strap passage 11 from the passage 10 after being tightened is pressed and fixed to the sliding plate 2 by the upward movement of the second clamp 4.

The pressing device 5 during its upward movement and the first clamp 3 cut the strap 51 and the moved up pressing device 5 presses the upper leading and lower trailing ends of the strap 51 to the sliding plate 2 with the upper leading and lower trailing ends of the strap 51 laid one on top of another.

The heater moves when the pressing device is moving up and goes between the upper and lower strap ends and is held between the straps by the pressure of the pressing device 5 and fuses the opposing faces of the straps by heat. The heater, while being pressed, then moves out from between the straps. Accordingly, the ends of the strap 51 come together and are welded by pressure of the pressing device 5.

The moving up and down of the first clamp 3, the second clamp 4 and the pressing device 5 and the moving back and forth of the sliding plate 2 and the heater are controlled by a cam device 12.

In order to conduct the process of packaging by using the above described automatic package strapping machine, the package 52 is put on the table 1 with the first clamp 3, the second clamp 4 and the pressing device 5 moved down, and with the sliding plate 2 in a forward position, and the strap 51 loaded in the full length of the arch-shaped frame 8, and then a starting switch is turned on.

First, the first clamp 3 moves up and clamps the leading end of the strap 51 and next, the strap-tightening device 7 operates and pulls back the strap 51 and the strap 51 which separates from the arch 8 is looped around the package 52 and tightened, and then the second clamp 4 moves up and clamps a part of the fed strap 51 and the leading end thereof simultaneously and the looped and tightened strap is held.

Next, as the pressing device 5 moves up and the heater moves back and forth, the strap 51 is cut and the upper leading end and lower trailing end of the strap 51 are welded by heat and pressure.

After the strap 51 is welded, the first and second clamps 3 and 4 and the pressing device 5 move down and the sliding plate 2 moves back and is drawn out from between the package 52 and the strap 51, so that the package 52 can be removed from the table 1, and then the sliding plate 2 returns to a forward position and the strap 51 is again loaded along the full length of the arch 8 and as a result, the machine is ready for the next package.

In the above described automatic package strapping machine, when the process of packaging is to be repeated, a speed up of the process of packaging is required so that a following packaging can be moved into the machine without delay.

In a conventional automatic package strapping machine, before the step of loading the next strap 51 along the arch 8 after a cutting and welding of the strap, the strap-forwarding device 6 is stopped during the process of cutting and welding the strap and while the sliding plate 2 moves back and is drawn out from between the package 52 and the strap 51, and only when the sliding plate 2 returns to a forward position is the strap-forwarding device 6 operated to feed the strap 51 and guide the leading end of the strap to the strap passage 11 through the passage 10 of the first clamp 3.

Thus, in order to feed the strap after the strap has been cut and welded, it is necessary to wait until the sliding plate 2 moves back and then returns to a forward position. Therefore, time is consumed and a speed up of the process of packaging is prevented.

OBJECTS AND BRIEF SUMMARY OF THE INVENTION

One object of the present invention is to provide an automatic package strapping machine capable of speeding up the whole process of packaging by shortening the time for feeding the strap.

Another object of the present invention is to provide an automatic package strapping machine capable of feeding the strap and guiding the strap along the arch while the sliding plate has been moved back and remains there.

These objects are acknowledged by providing an automatic package strapping machine comprising:

a table;

a sliding plate movable in said table between a forward position and a rearward position;

a first clamp under the forward position of said sliding plate and movable up and down to press a leading end of a strap inserted under said sliding plate from one side of said sliding plate against the under side of said sliding plate when in an upper position, said first clamp having a passage for the strap extending therethrough;

a second clamp under the forward position of said sliding plate and movable up and down to fix a part of the strap extending thereover and the leading end of the strap against the under side of said sliding plate when in an upper position;

a pressing device under the forward position of said sliding plate and between said first and second clamps and movable up and down for cutting the strap in cooperation with said first clamp as said pressing device is moving up relative to said first clamp and for pressing the part of the strap and the leading end thereof against the under side of said sliding plate when at an upper position;

a heater movable back and forth between a forward position which is between the forward position of said sliding plate and said pressing device and a retracted position for, in the forward position, being held between the part of the strap and the leading end thereof and fusing surfaces of the part of the strap and the leading end thereof;

a strap feeding means for feeding a strap through said passage for the strap, over said pressing device and said second clamp and in an arch over said table;

a strap guide mounted on said machine adjacent said second clamp and movable back and forth between a projected position in which said strap guide projects over said second clamp and said pressing device and is spaced therefrom to form a strap path over said second clamp and said pressing device and leading to the arch, and a retracted position; and means for moving said strap guide to said projected position when said second clamp moves upwardly.

BRIEF DESCRIPTION OF THE DRAWINGS

The manner in which the foregoing and other objects of this invention are accomplished will be apparent from the accompanying specification and claims considered together with the drawings, wherein:

DETAILED DESCRIPTION OF THE PREFERRED EMBODIMENT

Figure 1:
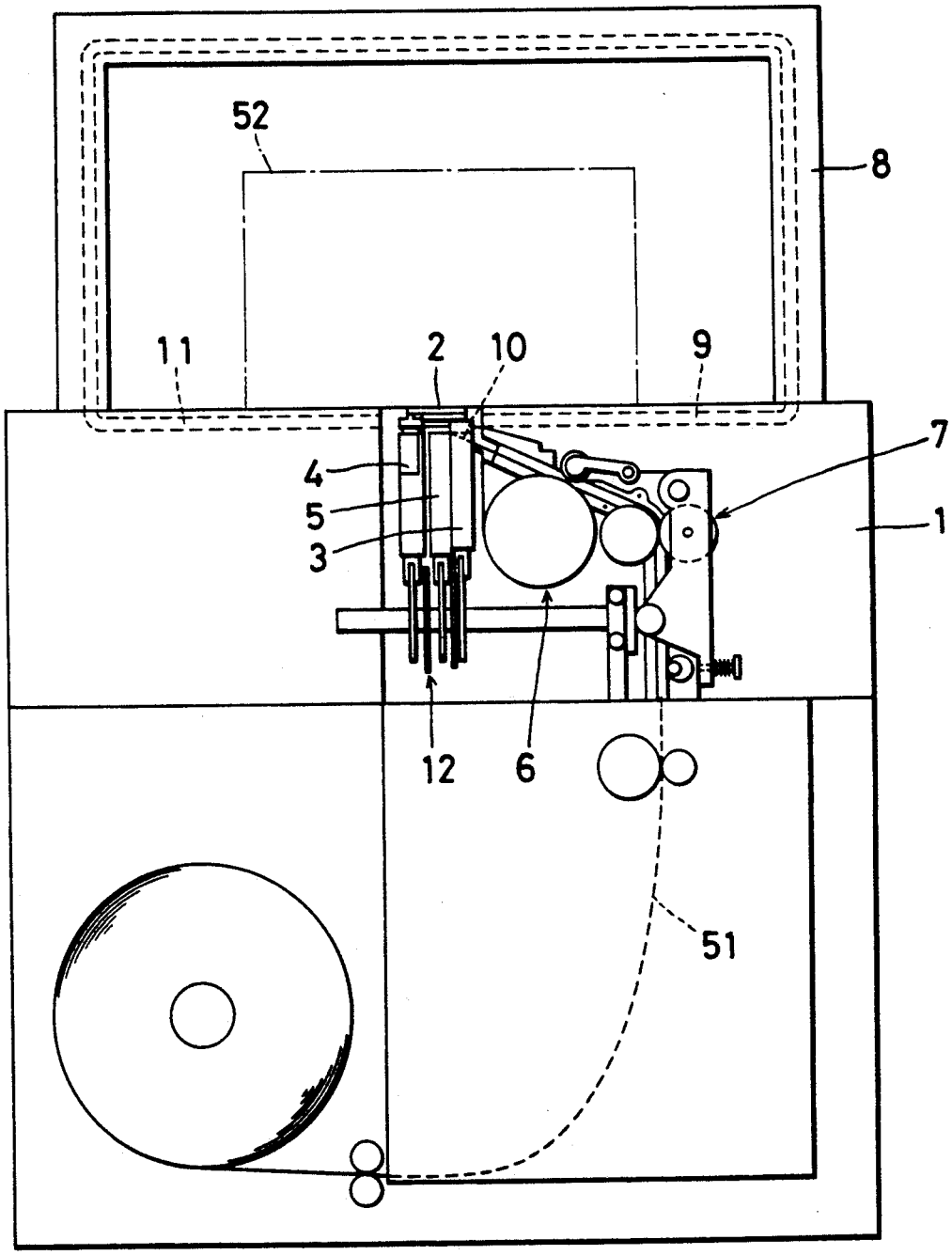
FIG. 1 (PRIOR ART)
FIG. 1 is a front view showing the overall structure of an automatic package strapping machine.
Figure 2:
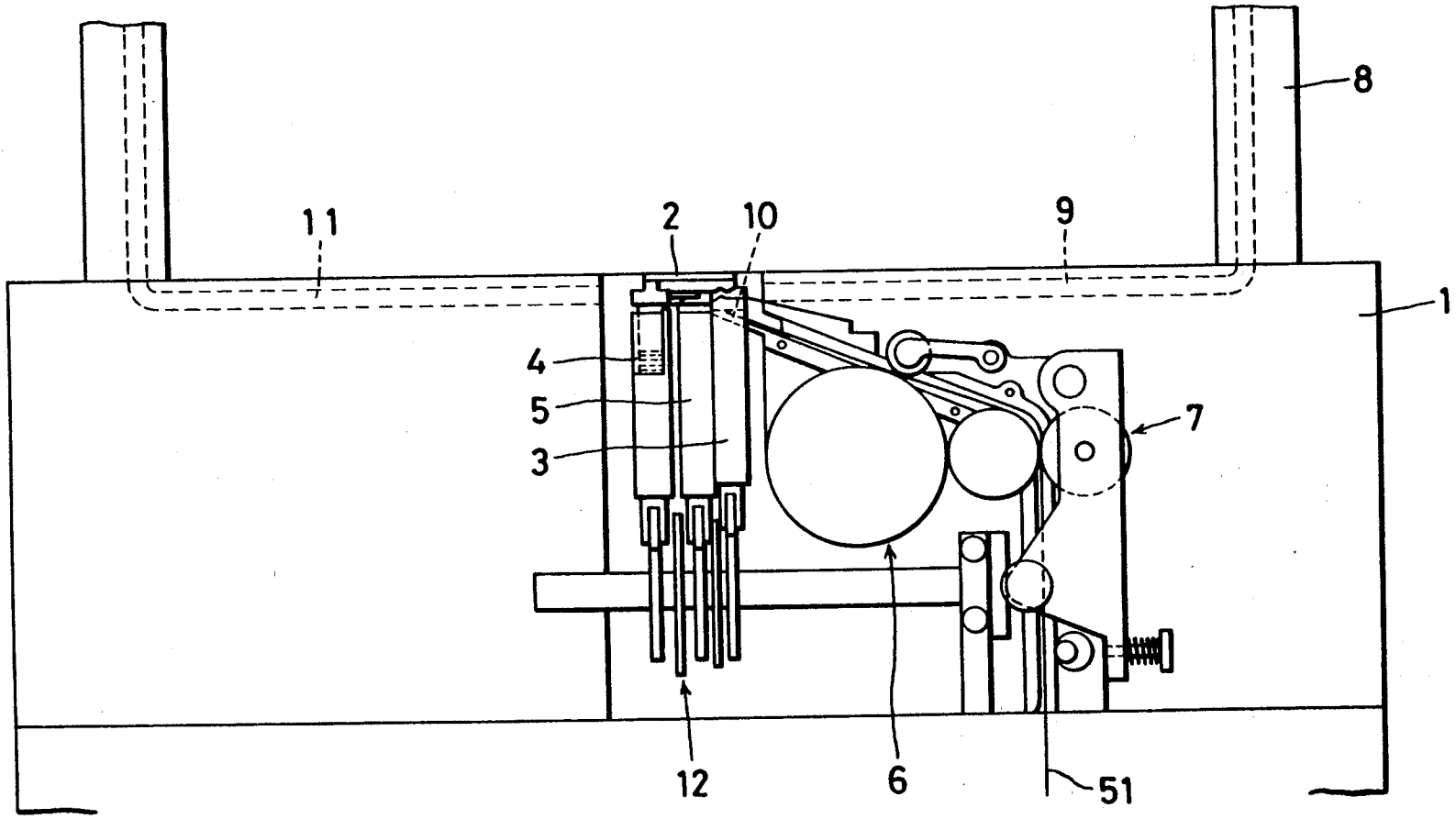
FIG. 2 (PRIOR ART)
FIG. 2 is an enlarged front view showing the principal part of FIG. 1.

The basic structure of an automatic package strapping machine is shown in FIG. 1 and FIG. 2. The present invention is an improvement in that a strap guide 21 is disposed at the upper rear of the second clamp 4 and a guide passage 32 for the strap 51 which goes to the arch 8 is formed by the strap guide 21 and the upper end surface of the second clamp 4, so that the strap-forwarding device 6 can always be operated.

As shown in FIGS. 3 to 6, the strap guide 21 is located at the upper rear of the second clamp 4 and placed in a front concave recess 23 provided in a fixing member 22 which supports the sliding plate 2. The strap guide comprises a lower end cylindrical part 24, an upright part 25 provided on the cylindrical part 24, a guide part 26 extending perpendicularly from the upper end of the upright part 25 and a cam pawl 27 provided at the lower end of the upright part 25 so as to project laterally therefrom.

Figure 6:
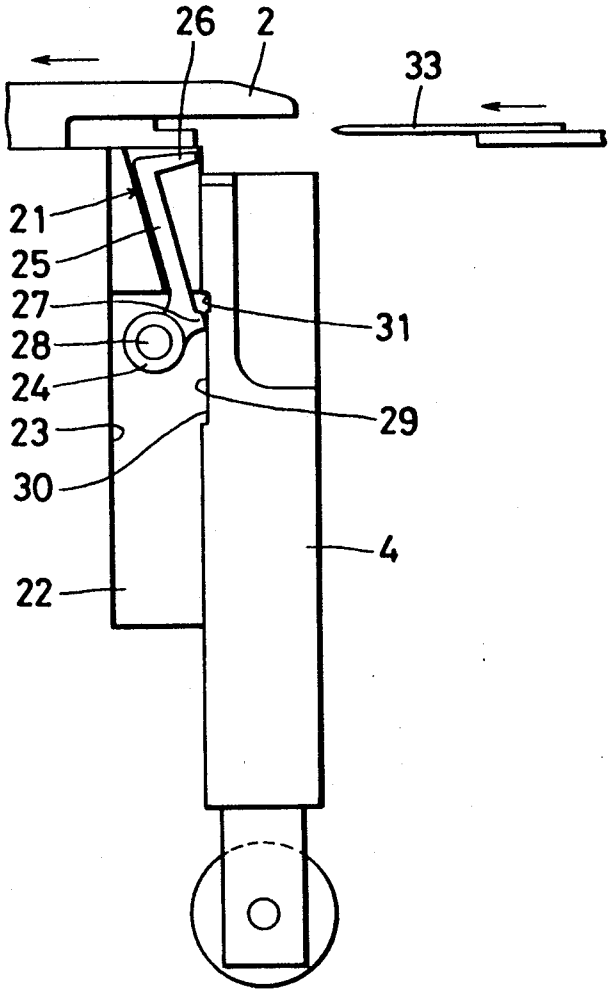
FIG. 6 is a side elevation view showing the strap guide which moves back.

As shown in FIG. 6, in the above strap guide 21, the lower end cylindrical part 24 is fixed to the fixing member 22 on a shaft 28 and oscillates freely centering around the shaft 28, and the cam pawl 27 contacts with a cam surface 29 provided at the rear of the second clamp 4.

The cam surface 29 has a shallow surface 30 and a deep concave part 31 and as shown in FIG. 6, when the second clamp 4 is moving up, the shallow surface 30 contacts with the cam follower 27 and pushes the cam pawl 27 up so as to cause the strap guide 21 to be inclined rearwardly and the guide part 26 at the upper end to be moved out of the space into which the second clamp moves up.

Figure 5B:
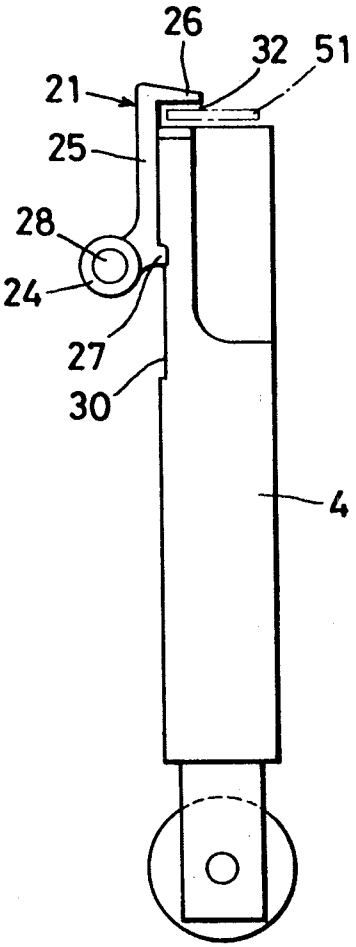
FIG. 5(B) is a side view thereof.

Further, when the second clamp 4 is in a lowered position, as shown in FIG. 5(B), the cam follower 27 is in the deep concave part 31 and the upper end of the deep concave part 31 pulls the cam follower 27 down and the strap guide 21 stands straight upright and the guide part 26 projects over and is spaced from over the upper end surface of the second clamp 4 and as a result, a guide passage 32 for the strap 51 is formed between the guide part 26 and the upper end surface of the second clamp 4.

Figure 3:
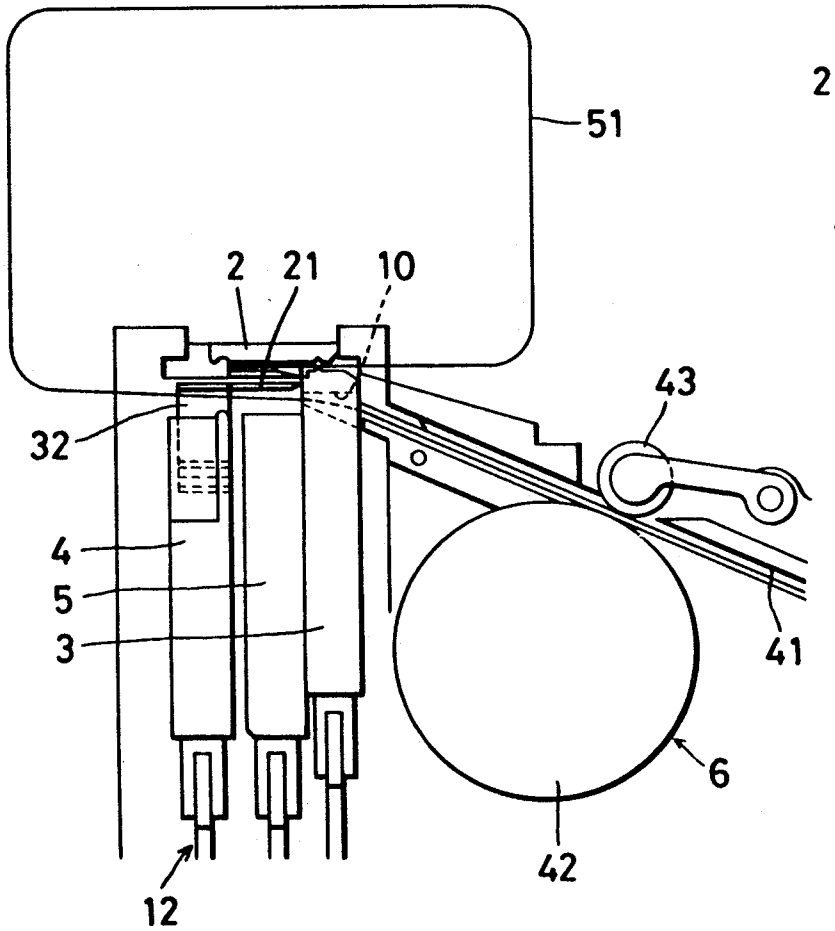
FIG. 3 is a front elevation view showing the principal part of an automatic package strapping machine in which a strap is provided in accordance with the present invention.
Figure 5A:
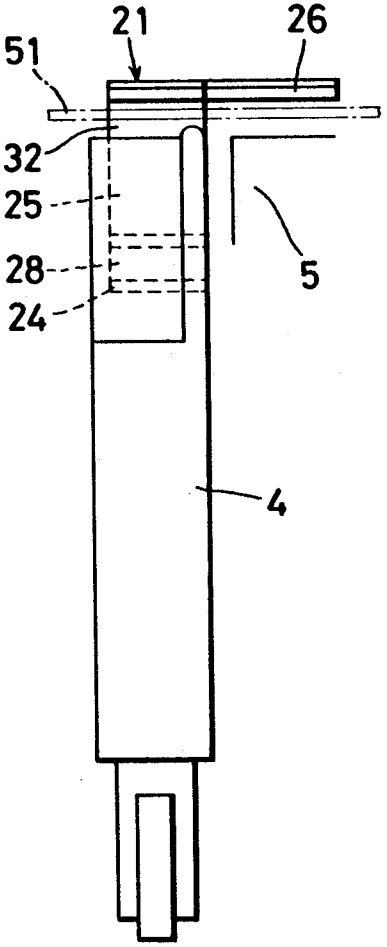
FIG. 5(A) is a front elevation view showing a strap guide into which a strap is guided.

As shown in FIG. 3 and FIG. 5(A), the guide part 26 of the strap guide 21 also extends over the pressing device 5 and is long from side to side so as to reach the side surface of the first clamp 3 so that the guide passage 32 for the strap 51 is also formed over the pressing device 5.

In the up and down movement of the second clamp 4 and the pressing device 5, since the second clamp 4 moves up first and moves down simultaneously with the pressing device 5, even if the guide part 26 projects over the pressing device 5, the pressing device 5 is not prevented from moving up and down, and the strap guide passage 32 formed when the pressing device 5 and the second clamp 4 are moved down is located so as to link with the passage 10 of the moved down first clamp 3 as shown in FIG. 3, and as a result, the strap 51 moves into the guide passage 32 from the passage 10 smoothly.

The strap feeding device 6 at the right side of the first clamp 3 in FIG. 3 comprises a strap feeding roller 42 which rolls in a strap feeding direction contacting and rolling along the lower surface of the strap 51 and a follower roller 43 which is above the roller 42 and presses the strap 51 against the roller 42 in a passage 41 which guides the strap 51 to the passage 10 of the first clamp 3, and the follower roller 43 is moved up and down by a solenoid, not shown here, for pressing and releasing the strap 51.

The above strap feeding roller 42 is driven by a motor (now shown) only in a strap feeding direction and the pressure of the follower roller 43 on the strap 51 is controlled so that the strap feeding roller 42 slips without damaging the strap 51 when the leading end of the strap 51 is stopped by contacting with the pressing device 5.

Accordingly, the pressure of the follower roller 43 can be controlled according to the kind of the strap 51 being used.

An operation, before the process of packaging is started, the first and second clamps 3 and 4 and the pressing device 5 are in a down position and the sliding plate 2 is in a forward position over the clamps and pressing device and the strap 51 is loaded along the full length of the arch 8 from the passage 41 through the passage part 10, the guide passage 32 and the strap passage 11, and the leading end thereof passes through the strap passage 9 and goes under the sliding plate 2 and a limit switch (not shown) is engaged thereby and turned on.

The package 52 is put in the arch 8 on the table 1 in order to conduct the process of packaging and a starting switch is pressed on, and the roller 42 which feeds the strap is drawn and the follower roller 43 is partly separated from and slips on the strap 51.

The first clamp 3 moves up first upon lifting by a cam device 12 and clamps the leading end of the strap 51 by pressing it against the under side of the sliding plate 2, and next the strap feeding device 7 (FIG. 1) operates and pulls back the strap 51 and the strap 51 separated from the arch 8 and the strap passages 9 and 11 and is looped around the package 52 and tightened.

After the strap is tightened, the second clamp 4 moves up and presses a part of the strap 51 and the leading end thereof which are laid one on top of another against the under side of the sliding plate 2 and clamps the strap 51 so that the strap 51 cannot be loosened. Since the cam pawl 27 is pushed up by the cam surface 29, the strap guide 21 is inclined backward as shown in FIG. 6 while the second clamp 4 is moving up and does not prevent the second clamp 4 and the pressing device 5 from moving up.

Figure 4:
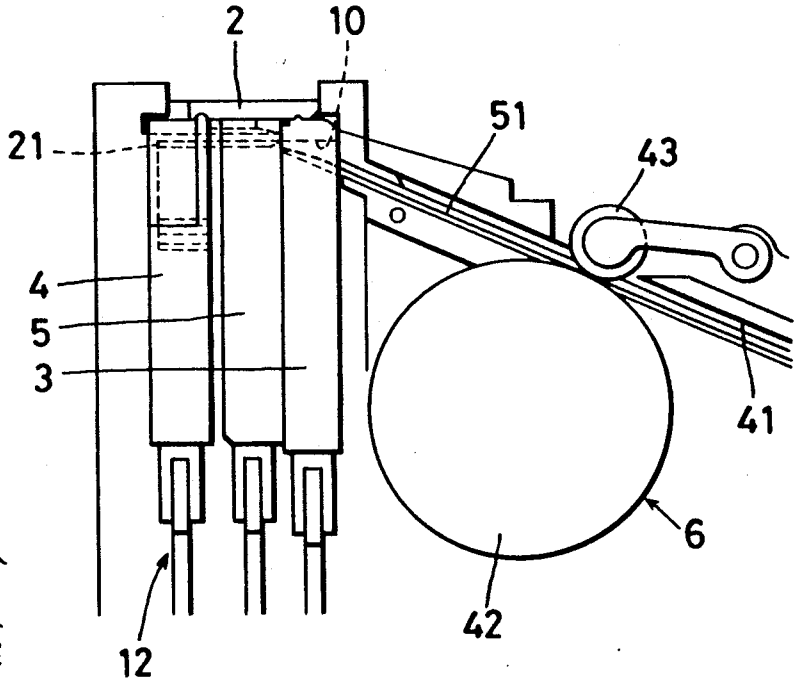
FIG. 4 is a front elevation view showing the principal parts in FIG. 3 in positions in which the strap is welded.

Next, the pressing device 5 moves up and in cooperation with the first clamp 3 cuts the strap 51 on the way up and the heater 33 moves between the upper and lower straps and the upper and lower strap parts and the heater are pressed together by the pressing device 5 and then the heater moves back and is drawn out from between the straps after heating and fusing opposite surfaces of the upper and lower strap parts and then the pressing device 5 further presses the upper and lower strap parts and as shown in FIG. 4 the ends of the strap 51 are welded.

When the strap 51 has been welded, the follower roller 43 moves down and presses the strap 51 against the strap feeding roller 42.

Since the strap 51 has been cut during the upward movement of the pressing device 5, the leading end of the strap for a next package contacts the side surface of the pressing device 5, and since the strap feeding roller 42 slips against the strap 51, as a result, the process of feeding the strap is stopped.

After the ends of the strap are welded, the first and second clamps 3 and 4 and the pressing device 5 move down and then the sliding plate 2 moves back and is drawn out from between the package 52 and the strap 51.

Since the cam follower 27 is pulled down by the concave part 31 of the cam surface 29, the strap guide 21 moves to the straight up position as shown in FIG. 5(B) during the downward movement of the second clamp 4, and the guide part 26 projects over the second clamp 4 and the pressing device 5 and the strap guide passage 32 is formed.

Further, since the upper end surface of the pressing device 5 moves down lower than the passage 10 of the first clamp 3 along the moved down first clamp 3, the leading end of the strap is no longer prevented from being fed and the strap 51 is fed by the strap feeding roller 42 and the follower roller 43 and the leading end of the strap 51 moves along the under surface of the guide part 26 within the guide passage 32 and is guided accurately to the strap passage 11 and is fed around the arch 8.

The sliding plate 2 which is in the retracted position at the time of the start of feeding of the strap is returned to a forward position while the leading end of the strap 51 runs within the arch 8. Thus, the leading end of the strap 51 which reaches the strap passage 9 from the inside of the arch 8 goes under the sliding plate 2 and presses the limit switch (not shown). the switch detects the presence of the leading end of the strap and actuates the solenoid for the follower roller 43 to move it up so that it stops pressing the strap 51 against the feed roller 42, and as a result, the machine is ready for a next package.

As described above, the strap 51 can be loaded in the arch 8 after the pressing device 5 starts to move down and while the sliding plate 2 returns to a forward position and as a result, time during which the strap cannot be fed while sliding plate moves back and returns to a forward position can be shortened in the process of strapping, as compared with a conventional machine in which the strap is fed only after the sliding plate is returned to a forward position.

According to the present invention, since the strap can be loaded in the arch while the pressing device and the second clamp move down and the sliding plate moves back and returns to a forward position, the time for the process of strapping can be shortened by the time the parts of the process overlap and the process of strapping can be speeded up.

Although the invention has been described in its preferred form with a certain degree of particularity, it is understood that the present disclosure of the preferred form may be changed in the details of construction and the combination and arrangement of parts may be resorted to without departing from the spirit and the scope of the invention as hereinafter claimed.

What is claimed is:

1. An automatic package strapping machine, comprising:

a table;

a sliding plate movable in said table between a forward position and a rearward position;

a first clamp under the forward position of said sliding plate and movable up and down to press a leading end of a strap inserted under said sliding plate from one side of said sliding plate against the under side of said sliding plate when in an upper position, said first clamp having a passage for the strap extending therethrough;

a second clamp under the forward position of said sliding plate and movable up and down to fix a part of the strap extending thereover and the leading end of the strap against the under side of said sliding plate when in an upper position;

a pressing device under the forward position of said sliding plate and between said first and second clamps and movable up and down for cutting the strap in cooperation with said first clamp as said pressing device is moving up relative to said first clamp and for pressing the part of the strap and the leading end thereof against the under side of said sliding plate when at an upper position;

a heater movable back and forth between a forward position which is between the forward position of said sliding plate and said pressing device and a retracted position for, in the forward position, being held between the part of the strap and the leading end thereof and fusing surfaces of the part of the strap and the leading end thereof;

a strap feeding means for feeding a strap through said passage for the strap, over said pressing device and said second clamp and in an arch over said table;

a strap guide mounted on said machine adjacent said second clamp and movable back and forth between a projected position in which said strap guide projects over said second clamp and said pressing device and is spaced therefrom to form a strap path over said second clamp and said pressing device and leading to the arch, and a retracted position; and means for moving said strap guide to said projected position when said second clamp moves upwardly.

2. An automatic package strapping machine as claimed in claim 1 in which said means for moving said strap guide comprises a cam surface on said second clamp and a cam follower on said strap guide engaged with said cam surface to move said strap guide to said projected position as said second clamp is moved upwardly, and to move said strap guide to the retracted position when said second clamp is moved downwardly.

3. An automatic package strapping machine as claimed in claim 1 in which said strap feeding means includes a means engaging said strap and urging said strap in the feeding direction and including means for causing the engagement with said strap to be a slipping engagement when the strap is fed through said passage for the strap in said first clamp and abuts said pressing device when said pressing device is in the upper position.

* * * * *